US006250238B1

(12) United States Patent
Resta

(10) Patent No.: US 6,250,238 B1
(45) Date of Patent: Jun. 26, 2001

(54) DEVICE FOR POSITIONING AND JOINING AT AN ANGLE THE EDGES OF TWO SHEETS TO BE STITCHED IN A SEWING MACHINE, PARTICULARLY FOR FORMING A MATTRESS CASE

(75) Inventor: Roberto Resta, Faenza (IT)

(73) Assignee: Resta S.r.l., Faenza (IT)

( * ) Notice: Subject to any disclaimer, the term of this patent is extended or adjusted under 35 U.S.C. 154(b) by 0 days.

(21) Appl. No.: 09/627,066

(22) Filed: Jul. 27, 2000

(30) Foreign Application Priority Data

Aug. 17, 1999 (IT) ..... B099A0462

(51) Int. Cl.[7] ..... D05B 11/00; D05B 27/10

(52) U.S. Cl. ..... 112/2.1; 112/322

(58) Field of Search ..... 112/2.1, 318, 322, 112/63, 470.29, 470.31, 470.32, 141, 475.08, 475.04, 470.07

(56) References Cited

U.S. PATENT DOCUMENTS 5,251,557 * 10/1993 Rohr ..... 112/322
5,370,072 * 12/1994 Adamski, Jr. ..... 112/322
5,540,164 * 7/1996 Grantham et al. ..... 112/318
5,709,162 * 1/1998 Pagett et al. ..... 112/470.07
5,743,202 * 4/1998 Price et al. ..... 112/470.29

FOREIGN PATENT DOCUMENTS 0 857 805 8/1998 (EP) .

* cited by examiner

*Primary Examiner*—Ismael Izaguirre
(74) *Attorney, Agent, or Firm*—Guido Modiano; Albert Josif; Daniel O'Byrne

(57) ABSTRACT

A device for positioning and joining at an angle, by a sewing machine, the edges of two flaps of fabric, particularly of a horizontal sheet and of a vertical band for forming a mattress case, said device comprising a first guiding wall for the edge of the sheet and a second guiding wall for the edge of the band, said walls forming mutually adjacent cylindrical sectors, two advancement elements being further provided which comprise rotating heads accommodated within cavities formed by said walls, said walls being movable between a position in which said rotating heads tangentially engage the edges of said sheet and said band on said walls in order to advance said edges toward a sewing region and a position in which said walls allow said heads to disengage from said walls.

3 Claims, 3 Drawing Sheets

DEVICE FOR POSITIONING AND JOINING AT AN ANGLE THE EDGES OF TWO SHEETS TO BE STITCHED IN A SEWING MACHINE, PARTICULARLY FOR FORMING A MATTRESS CASE

BACKGROUND OF THE INVENTION

The present invention relates to a device for positioning and joining at an angle the edges of two sheets to be stitched in a sewing machine, particularly for forming a mattress case.

Conventional mattress cases are constituted by an upper sheet and a lower sheet which are rectangular, have rounded corners and are connected one another by a perimetric band.

The band is joined to the sheets by stitching with the aid of a border forming machine which, in practice, is a sewing machine which joins one another the adjacent edges of one sheet and of the perimetric band, with or without interposing a covering tape. Since the sheet is rested horizontally above the mattress body and the band must wrap around the body vertically, in order to achieve a stitched seam that joins one another the contiguous edges of the sheet and of the band the sewing machine is arranged at a 45° angle, so that the needle can pass through both edges and stitch them.

Currently, the edges are positioned manually by operators as sewing progresses. This requires the assigned personnel to be highly skilled and also to perform a significant physical effort, since the sheet and the band must be properly tensioned to avoid forming creases.

Italian Patent No. 1,290,666 by the same Applicant discloses a new device which allows to mutually position the edges of two sheets arranged at 90° to each other, particularly of a sheet and of the perimetric band of a mattress, without requiring any manual intervention. The device is characterized by an angular element comprising a first laminar channel which forms a guide for the edge of the sheet and a second laminar channel which forms a guide for the edge of the band; the channels are arranged at right angles and each channel is comprised between two walls, of which one lies outside the right angle and the other is arranged inside it, and respective through openings are formed in the outer walls; two advancement elements are further provided which comprise rotating heads arranged so as to tangentially engage the sheet and the band through the through openings, in order to arrange the edges of the sheet and of the band, guided in the channels, adjacent to each other.

Problems have occurred with this device when, in order to complete the peripheral stitching of the mattress, it is necessary to remove the abutment of the rotating advancement heads.

SUMMARY OF THE INVENTION

The aim of the present invention is to provide a device which allows to disengage the advancement heads in order to perform final stitching.

Within the scope of this aim, an object of the present invention is to provide a device which is structurally simple and reliable in operation and with which disengagement of the advancement heads occurs automatically.

These and other objects are achieved with a device for positioning and joining at an angle, by means of a sewing machine, the edges of two flaps of fabric, particularly of a horizontal sheet and of a vertical band for forming a mattress case, characterized in that said device comprises a first guiding wall for the edge of the sheet and a second guiding wall for the edge of the band, said walls forming mutually adjacent cylindrical sectors, two advancement elements being further provided which comprise rotating heads accommodated within the cavities formed by the respective walls, said walls being movable between a position in which said rotating heads tangentially engage the edges of said sheet and said band on said walls in order to advance said edges toward a sewing region and a position in which said walls allow said heads to disengage from said walls.

BRIEF DESCRIPTION OF THE DRAWINGS

Further characteristics and advantages of the present invention will become better apparent from the following detailed description of a preferred but not exclusive embodiment thereof, illustrated only by way of non-limitative example in the accompanying drawings, wherein.

DESCRIPTION OF THE PREFERRED EMBODIMENTS

With reference to the above figures, 1 generally designates a device according to the present invention which cooperates to the formation of the border of a mattress.

The term "border" designates the peripheral stitching of the two upper and lower sheets of the case of a mattress with the band that wraps around the mattress peripherally.

The border is normally produced in two steps. In a first step, the edge of a sheet applied to the body of the mattress is joined to an edge of the peripheral band. Once this operation has been completed, the mattress is is turned over and the edge of the second sheet is stitched to the other edge of the band. Accordingly, the sheet that is joined to the peripheral band always lies above of the mattress body, while the band lies at right angles to it and extends downward from the edge of the sheet.

Figure 1:
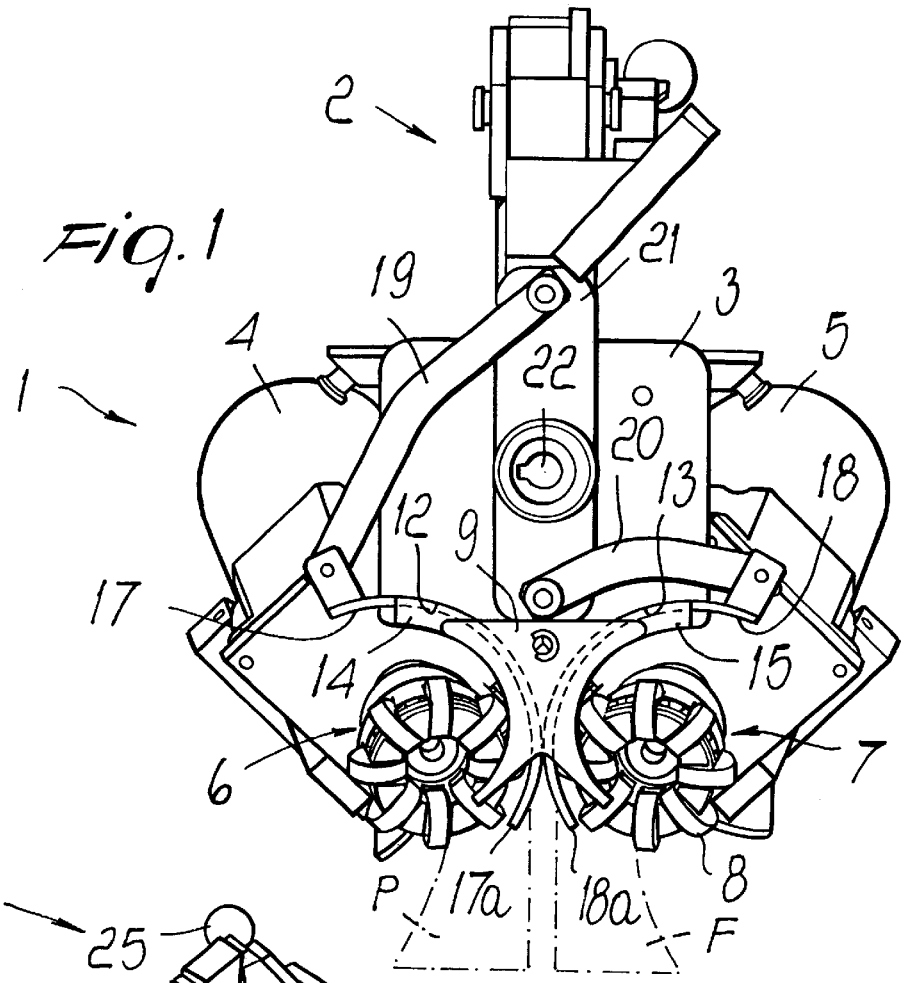
FIG. 1 is a front perspective view of the device according to the present invention.
Figure 2:
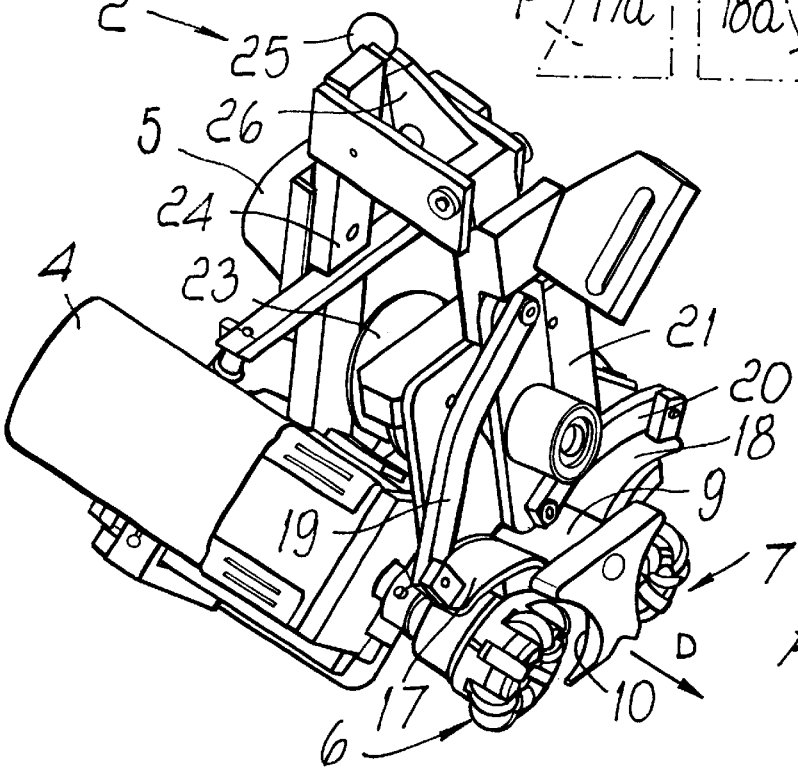
FIGS. 2, 3, 4 and 5 are three more perspective views of the device.
Figure 3:
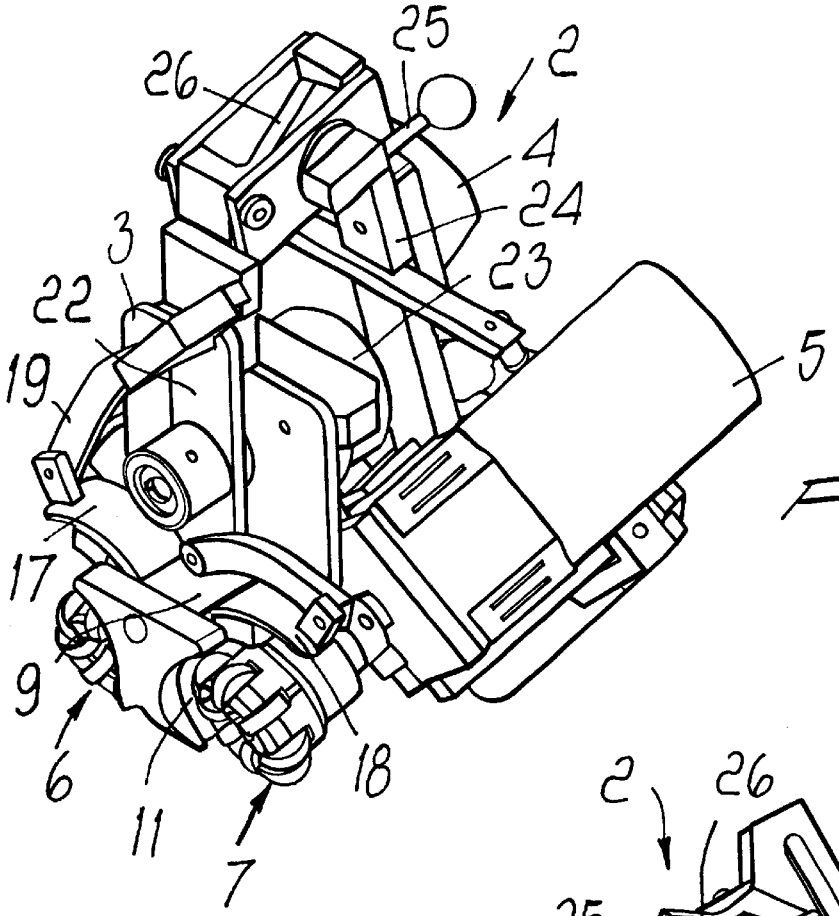
Figure 4:
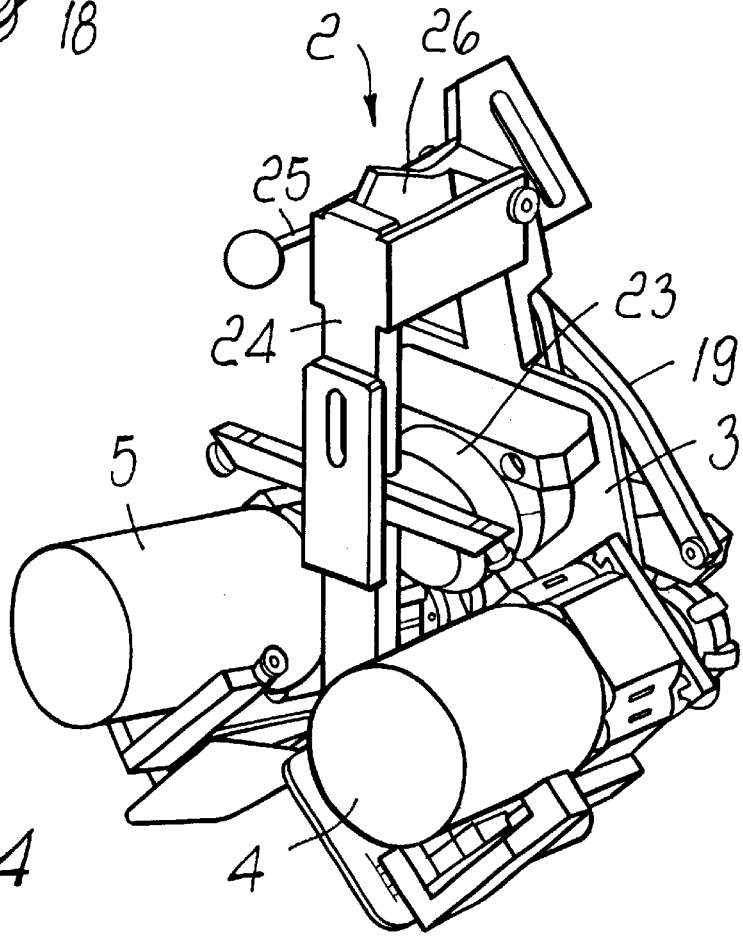
Figure 5:
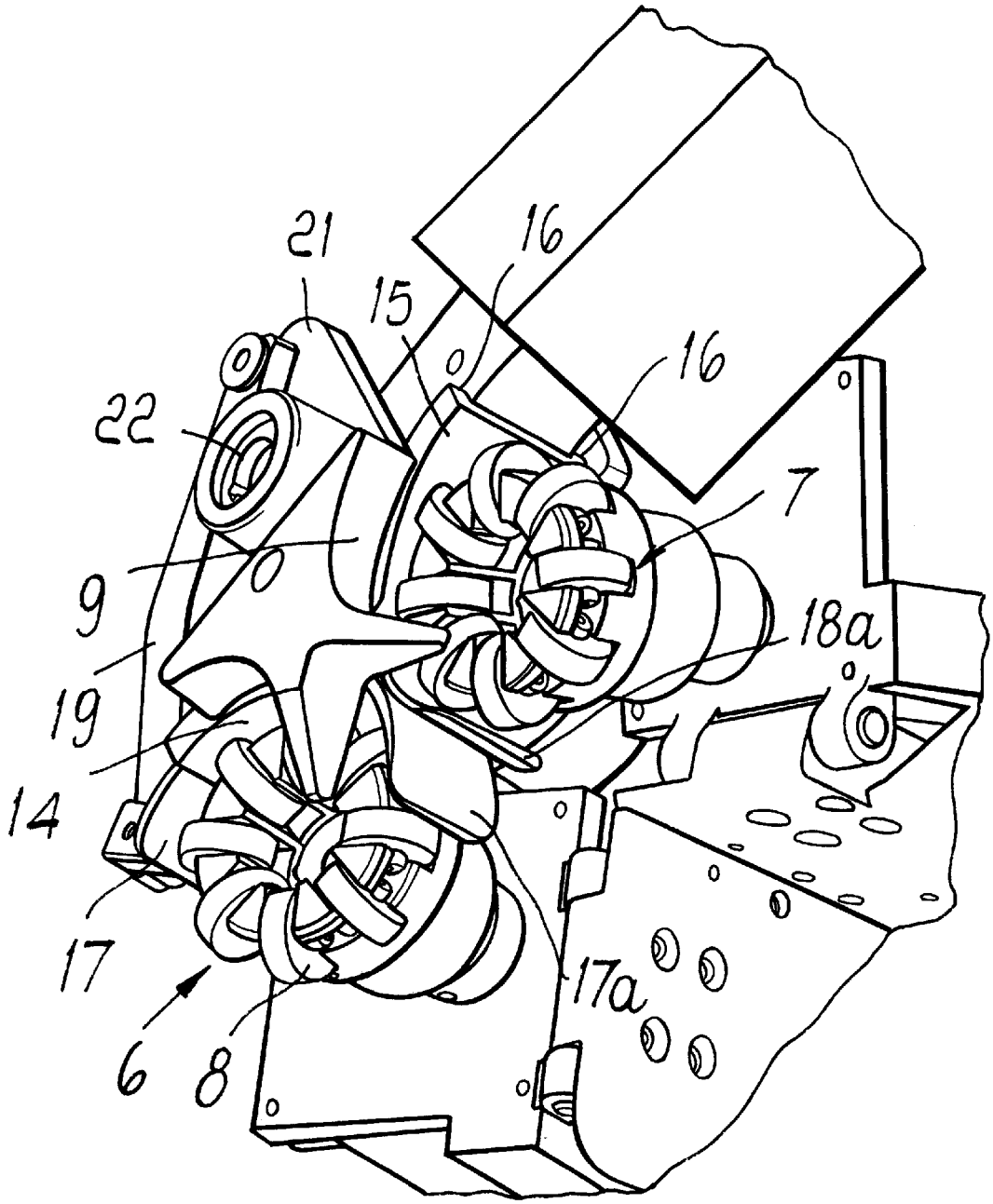

In FIG. 1, the reference letters P and F designate the two flaps of the sheet and of the band to be stitched together along their edges by means of a sewing machine, which is not shown in the drawings. For sake of better comprehension of the association of the device with the sewing machine and of the stitching method, reference is made to Italian Patent No. 1,290,666, which is referenced herein as an integral part of the present invention.

The device 1 comprises a frame, generally designated by the reference numeral 2, which is fixed in any manner ahead of the sewing machine.

The frame 2 has a plate 3 to which two motors 4 and 5 are flanged; the rotating heads 6 and 7 for moving the sheet P and the band F are keyed onto the output shafts of the motors. The heads are fully similar to the ones described and illustrated in the Italian Patent No. 1,290,666 and converge in the direction D along which the sheet P and the band F are fed. In particular, the heads 6 and 7 have radial rollers 8 which are knurled peripherally in order to facilitate the advancement of the sheet and of the band.

Moreover a block 9 is fixed to the plate 3, protrudes between the rotating heads 6 and 7, and has, on its opposite faces, two cylindrical cavities 10 and 11 which partially accommodate the rotating heads 6 and 7.

Respective cylindrical slots 12 and 13 are formed in the cylindrical surfaces that form the two cylindrical cavities 10 and 11, and arc-like secondary plates 14 and 15, fixed to the block 9, are recessed in the slots. The secondary plates 14 and 15 have, along their arc-like lateral edges, ribs 16 which give them a U-shaped cross-section. In this way, the plates, once recessed in the respective slots 12 and 13, form with the bottom of said slots two cylindrical channels which have a rectangular cross-section.

Respective cylindrical sectors 17 and 18 of walls 17*a*, 18*a* are guided in said channels and in the portions of the slots that are not covered by the secondary plates 14 and 15; the lower portions of said walls lie between and around the rotating heads 6 and 7. The lower portions are substantially tangent to the heads 6 and 7, so that the sheet P and the band F, during the border forming step, can be engaged by the heads and drawn toward the stitching area.

The upper ends of the cylindrical sectors 17 and 18 protrude from the channels formed by the plates 14 and 15 in the slots 12 and 13 and are articulately connected to linkages 19 and 20 whose opposite ends are articulated to the diametrically opposite ends of a lever 21 which is keyed in a rocker-like fashion on a shaft 22.

The shaft 22 is rotatably supported in the plate 3 and is moved with a reciprocating motion by a pneumatic actuator 23 which is mounted on the rear face of the plate 3.

The operation of the described device is as follows.

During stitching, the sheet P and the band F, as mentioned, are drawn toward the stitching area. During this step, the lower portions of the walls 17*a*, 18*a* are arranged below the heads so as to allow said heads to engage them and draw forward the sheet P and the band F.

When border forming is complete, the actuator 23 is activated; by turning the lever 21 from the vertical position shown in FIG. 1 to an inclined position, by means of the linkages 19 and 20, it causes the rotation in mutually opposite directions of the two cylindrical sectors 17 and 18 of the two walls 17*a* and 18*a*, allowing said walls to disengage from the rotating heads and thus allowing the sewing machine to complete its stitching. It should be noted that the rotation of the sectors 17 and 18 occurs by sliding in the slots 12 and 13. By actuating the actuator 23 in the opposite direction, the lower portions of the walls 17*a*, 18*a* are returned below the heads 6 and 7 and the border forming cycle can resume in the usual manner.

It is evident that the present invention fully achieves the intended aim and objects. In particular, it should be observed that the device, once the walls 17*a*, 18*a* have been moved away by sliding in the slots 12 and 13, can be moved to the disengagement position by providing a frame composed of a post 24 to which the plate 3 is articulated and a lever 25 which acts, by means of a cam 26, on the plate 3, lifting it and thus spacing the rotating heads from the walls 17*a* and 18*a*.

The disclosures in Italian Patent Application No. B099A000462 from which this application claims priority are incorporated herein by reference.

What is claimed is:

1. A device for positioning and joining at an angle, by means of a sewing machine, the edges of two flaps of fabric, particularly of a horizontal sheet and of a vertical band for forming a mattress case, wherein said device comprises a first guiding wall for the edge of the sheet and a second guiding wall for the edge of the band, said walls forming mutually adjacent cylindrical sectors, two advancement elements being further provided which comprise rotating heads accommodated within cavities formed by said walls, said walls being movable between a position in which said rotating heads tangentially engage the edges of said sheet and said band on said walls in order to advance said edges toward a sewing region and a position in which said walls allow said heads to disengage from said walls.

2. The device according to claim 1, wherein said device comprises a plate to which two motors are flanged, said motors having rotating heads for the advancement of said flaps, which converge in the feed direction of said flaps, a block which is fixed to said plate and protrudes between said rotating heads and has, on its opposite faces, two cavities which partially accommodate said rotating heads and form two cylindrical surfaces in which respective cylindrical slots are formed, arc-like secondary plates being recessed in said slots and being fixed to said block, said secondary plates having, along their arc-like lateral edges, ribs which are adapted to form cylindrical channels together with the bottom of said slots, respective cylindrical sectors of walls being guided in said channels, said walls lying, with a lower portion, between said rotating heads, said lower portions being substantially tangent to said heads, so that said flaps can be engaged by said heads and drawn toward the stitching region, and wherein upper ends of said cylindrical sectors are connected to actuation means which are adapted to cause a rotation in mutually opposite directions of said cylindrical sectors of said walls and allow said sectors to disengage from the rotating heads.

3. The device according to claim 2, wherein said sectors are articulately connected to linkages having opposite ends are articulated to diametrically opposite ends of a lever which is keyed in a rocker-like fashion on a shaft which is rotatably supported in said plate and is moved with a reciprocating motion by an actuator which is mounted on said plate.

* * * * *